US006481259B1

(12) United States Patent
Durney

(10) Patent No.: US 6,481,259 B1
(45) Date of Patent: Nov. 19, 2002

(54) METHOD FOR PRECISION BENDING OF A SHEET OF MATERIAL AND SLIT SHEET THEREFOR

(75) Inventor: Max W. Durney, San Francisco, CA (US)

(73) Assignee: Castle, Inc., Petaluma, CA (US)

( * ) Notice: Subject to any disclaimer, the term of this patent is extended or adjusted under 35 U.S.C. 154(b) by 0 days.

(21) Appl. No.: 09/640,267

(22) Filed: Aug. 17, 2000

(51) Int. Cl.[7] ..... B21D 28/00

(52) U.S. Cl. ..... 72/324; 72/379.2; 428/136; 229/931; 52/658; 493/43; 493/596

(58) Field of Search ..... 72/324, 332, 379.2; 428/577, 121, 130, 136, 134; 493/352, 356, 361, 596, 43; 229/931; 52/658

(56) References Cited

U.S. PATENT DOCUMENTS 975,121 A * 11/1910 Carter ..... 229/931
1,405,042 A * 1/1922 Kraft ..... 72/340
1,698,891 A * 1/1929 Overbury ..... 29/412
3,258,380 A * 6/1966 Fischer ..... 156/207
3,353,639 A * 11/1967 Andruiussi ..... 192/41 A
3,756,499 A * 9/1973 Giebel ..... 229/931
3,963,170 A * 6/1976 Wood ..... 229/185
4,289,290 A * 9/1981 Miller ..... 248/251
4,628,661 A * 12/1986 St. Louis ..... 72/379.2
5,692,672 A * 12/1997 Hunt ..... 229/931
5,885,676 A * 3/1999 Lobo et al. ..... 206/701
6,132,349 A * 10/2000 Yokoyama ..... 493/356
6,210,037 B1 * 4/2001 Brandon ..... 428/131

* cited by examiner

*Primary Examiner*—Daniel C. Crane
(74) *Attorney, Agent, or Firm*—Dorsey & Whitney LLP; Robert B. Chickering

(57) ABSTRACT

A method for precision bending of a sheet of material (31,41,61,91,231) along a bend line (35,45,62-66,96,235) and the resulting sheet are disclosed. A method includes a step of forming and longitudinally extending slits (33,43, 68,92,233) through the sheet of material in axially spaced relation to define bending webs (37,47,71,72,106,237), forming stress reducing structures such as enlarged openings (39,49,69,73) or transversely extending slits (239) at each of adjacent ends of pairs of slits in order to reduce crack propagation across the bending webs. In another aspect, the elongated slits (43,68,92,233) are formed with pairs of longitudinally extending slit segments (51,52;74,76;98, 99;127) proximate to and on opposite sides of and substantially parallel to the desired bend line. Longitudinally extending slit segments further are connected by at least one intermediate transversely extending slit segment (53,77,101, 128). Sheets of slit material suitable for bending also are disclosed.

47 Claims, 6 Drawing Sheets

METHOD FOR PRECISION BENDING OF A SHEET OF MATERIAL AND SLIT SHEET THEREFOR

TECHNICAL FIELD

The present invention relates, in general, to the bending of sheets of material, and more particularly, relates to slitting of the sheet material in order to enable precision bending.

BACKGROUND ART

A commonly encountered problem in connection with bending sheet material is that the locations of the bends are difficult to control because of bending tolerance variations and the accumulation of tolerance errors. For example, in the formation of the housings for electronics, sheet metal is bent along a first bend line within certain tolerances. The second bend, however, works off of the first bend and accordingly the tolerance errors accumulate. Since there can be three or more bends which are involved to create an enclosure, the effect of cumulative tolerance errors in bending can be significant.

One approach to this problem is to try to control the location of bends in sheet material through the use of slitting. Slits can be formed in sheet stock very precisely, for example, by the use of computer numerically controlled (CNC) controllers which control a slitter, such as a laser, water jet or punch press. Referring to FIG. 1, a sheet of material 21 is shown which has a plurality of slits 23 aligned in end-to-end, spaced apart relation along a proposed bend line 25.

Between pairs of slits are bending webs 27 which will be plastically deformed upon bending of sheet 21 and yet hold the sheet together as a single member.

The location of slits 23 in sheet 21 can be precisely controlled so as to position the slits on bend line 25 within relatively close tolerances. Accordingly, when sheet 21 is bent after the slitting process, the bend occurs at a position that is very close to bend line 25. Since slits can be laid out on a flat sheet of material precisely, the cumulative error is much less in such a slitting-based bending process as compared to one in which bends occur in a press brake with each subsequent bend being positioned by reference to the preceding bend.

Nevertheless, even slitting-based bending of sheet material has its problems. First, the stresses in bending webs 27, as a result of plastic deformation and slitting at both ends of webs 27, are concentrated. Thus, failures at webs 27 can occur. Moreover, the slits do not necessarily produce bending of webs 27 directly along bend line 25. Thus, in prior art slitting processes the problem of cumulative error in the bend location has been reduced, but stress concentration and somewhat erratic bending can occur.

Accordingly, it is an object of the present invention to provide method for precision bending of sheets of material using improved slitting techniques which both reduce stress concentrations at the bend web and enhance the accuracy of the bends.

Another object of the present invention is to provide a precision sheet bending process and a sheet of material which has been slit for bending and which can be used to accommodate bending of sheets of various thicknesses and of various types of materials.

A further object of the present invention is to provide a sheet bending method which results in a bent product having improved shear loading capacity.

Another object of the present invention is to provide an method for slitting sheets for subsequent bending, and the sheets themselves, that will accommodate both press brake bend and slit bends, is adaptable for use with existing slitting devices, enables sheet stock to be shipped in a flat condition and precision bent at a remote location without the use of a press brake, and enhances assembly or mounting of components in the interior of enclosures formed by bending of the sheet stock.

The method for precision bending of sheet material, and the sheet stock formed for such precision bending, of the present invention has other features and objects of advantage which will become apparent from, or are set forth in more detail in, the accompanying drawing and the following description of the Best Mode of Carrying Out The Invention.

DISCLOSURE OF INVENTION

In one aspect, the method for precision bending of a sheet of material of the present invention is comprised, briefly, of the steps of forming a plurality of longitudinally extending slits through the sheet in axially spaced relation in a direction extending along, and proximate to, a bend line to define bending webs between adjacent ends of pairs of the slits; and forming a stress reducing structure at each of the adjacent ends of the pairs of slits. The stress reducing structure can be provided by openings or transversely extending, preferably arcuate, slits formed on the bend line and opening to the longitudinally extending slits. The stress reducing openings have a transverse width dimension which is substantially greater than the transverse width dimension of the longitudinal slits, and the arcuate stress reducing slits are convex in a direction facing the bending webs. A further step of the method is the step of bending the sheet material substantially along the bend line across the bending webs between the stress reducing structures.

In another aspect, the method of the present invention includes slitting a sheet of material for precision bending which comprises the steps of forming a first elongated slit through the sheet of material along the bend line by forming a pair of proximate, transversely spaced apart, parallel and longitudinally extending, first slit segments connected near a common transverse plane by a transversely extending slit segment; and forming a second elongated slit in substantially longitudinally aligned and longitudinally spaced relation to the first elongated slit. The step of forming the second elongated slit also preferably is accomplished by forming a pair of proximate, transversely spaced apart, parallel and longitudinally extending, slit segments connected near a common transverse plane by a transversely extending slit segment. Thus, instead of one continuous elongated slit, each slit in the pair of slits is formed as a slightly stepped slit proximate a midpoint of the combined length of the slit segments. This structure produces a virtual fulcrum upon bending that can be positioned precisely on the bend line to cause bending of the bending webs more precisely along the bend line. In the most preferred form, the stepped slits are also provided with enlarged end openings so as to reduce stress concentrations at the bending webs.

The present invention also includes a sheet of material formed for precision bending comprising a sheet having elongated slits which are spaced apart in end-to-end relation and in substantial alignment along the bend line, and stress reducing structures at the ends of the slits to reduce stress concentrations. In the most preferred form the sheet of material further has the slits formed as stepped slits in which proximate, transversely spaced apart, parallel and longitudinally extending, slit segments are connected proximate a transverse intermediate plane by a transversely extending slit segment so that bending occurs at a virtual fulcrum. During bending, between the longitudinally extending slit segments tabs formed by the stepped slits slide on supporting edges of the sheet positioned across the slits from the tabs.

BEST MODE OF CARRYING OUT THE INVENTION

The present method for precision bending of sheet material includes two primary aspects, each of which are capable of being used alone, but which aspects preferably are used together. In one aspect, a stress reducing structure is formed at the ends of the slits to affect a stress concentration reduction in the connecting bending webs, while in another aspect, the slits are laterally or transversely stepped slightly over their length so as to produce bending about a virtual fulcrum. The most preferred method and resulting slitted sheets have both slightly stepped slits and stress reduced structures at the ends of the stepped slits.

Figure 1:
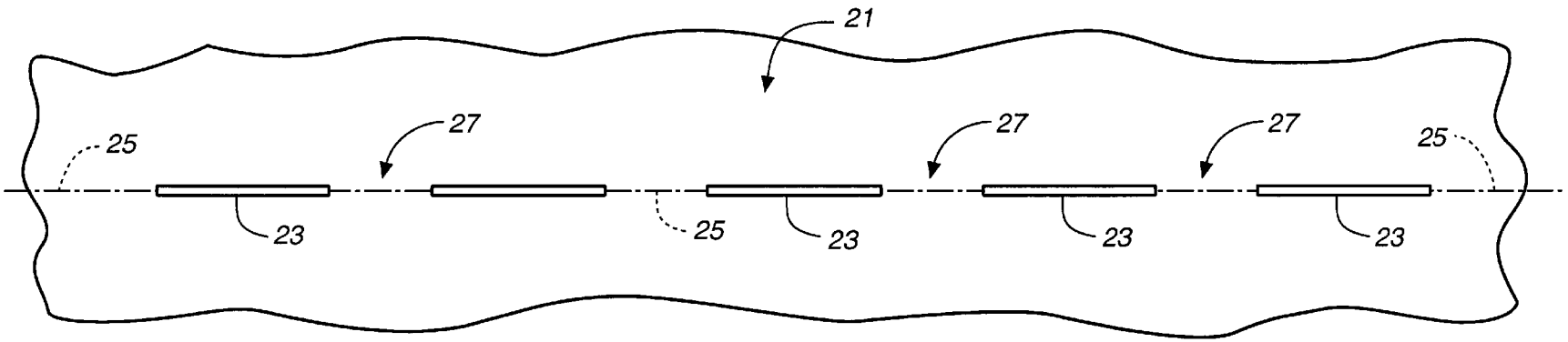
FIG. 1 (PRIOR ART)
FIG. 1 is a fragmentary, top plan view of a sheet of material having slits formed therein in accordance with prior art techniques.
Figure 2:
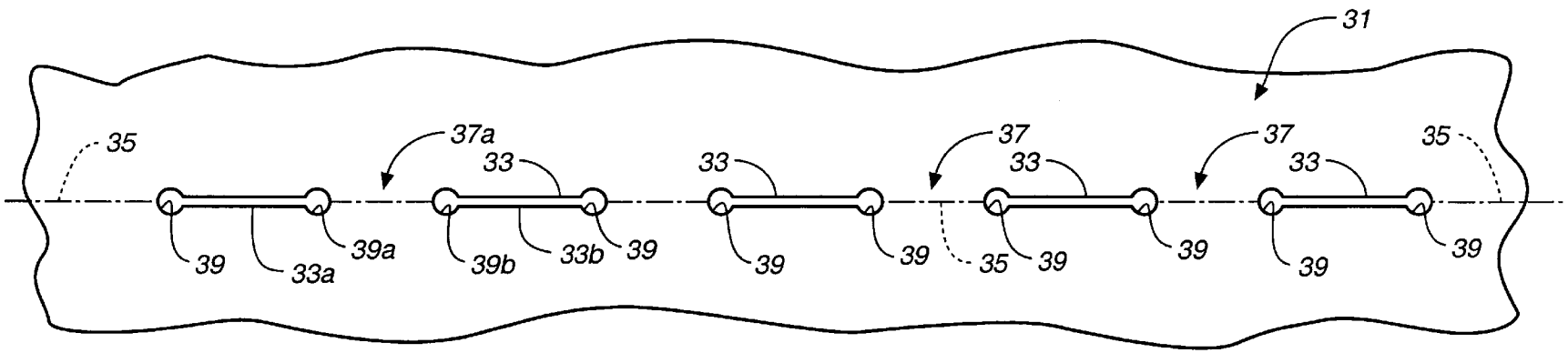
FIG. 2 is a fragmentary top plan view of corresponding to FIG. 1 of a sheet of material slit in accordance with one embodiment of a first aspect of the present invention.

Referring now to FIG. 2, a sheet of material 31 is shown in which the first aspect of the present invention has been employed. A plurality of longitudinally extending slits 33 are formed along a bend line 35 in a manner similar to the prior art technique shown in FIG. 1. The slits 33 are axially spaced and extend along and proximate to bend line 35 (preferably superimposed on the desired bend line) to define bending webs 37 between adjacent ends of pairs of slits 33. In the improved slitting method and resulting sheet, a stress reducing structure is provided or formed at each of the adjacent ends of pairs of slits. Thus, for slits 33*a* and 33*b* enlarged openings 39*a* and 39*b* are formed at the adjacent slit ends. Openings 39 are each formed on bend line 35 and open to or communicate with slits 33. Openings 39*a* and 39*b* have a transverse width dimension which is substantially greater than the transverse width dimension of slits 33*a* and 33*b*. For example, in an aluminum sheet having a thickness of 0.070 inches and slits with a kerf or slit width dimension of 0.015 inches, openings 39 can be 0.140 inches in diameter.

Upon bending of sheet 31, the openings 39 will reduce the stress concentration on bending webs 37 over that which is produced simply by forming narrow slits as shown in FIG. 1. Enlarged openings 39 will, in turn, give the bent sheet 31 greater strength along the bend line due to the resultant stress reduction in webs 37.

In the present invention, it is preferable that slits 33 have a width dimension less than the thickness dimension of the sheet of material, and that the enlarged stress reducing openings 39 have a width dimension that is greater than the thickness dimension of the sheet of material. Slits 33 can range from a kerf width dimension of zero to just slightly less than the thickness of the material. When a slitting knife is used, the slits essentially have no, or zero, transverse width dimension since no material is removed from the sheet during slitting. Material is only cut by the slitter and the opposite sides of the slit move back into contact with each other. When a laser or water jet is employed, however, there will be a kerf or slit width dimension that is a result of material being removed. Slits with kerfs are shown in FIGS. 1–3B and 8, while no kerfs are shown in FIGS. 3A, 4, 5, 6 and 7.

The most preferred from of stress-reducing opening is to have openings 39 have an arcuate shape on the side thereof facing the opposite aligned slit. Moreover, the arcuate shape of the opening is preferably centered on the bend line that the stress reducing structure provided by openings 39 also functions as a bend inducing structure making bending of web 37 more likely to occur on the bend line 35. It is believed that having an opening with corners or an apex facing the adjacent slit is less desirable than a circular or semicircular openings since corners or intersecting planar walls would tend to reintroduce stress concentrations along bend line 35.

Figure 3A:
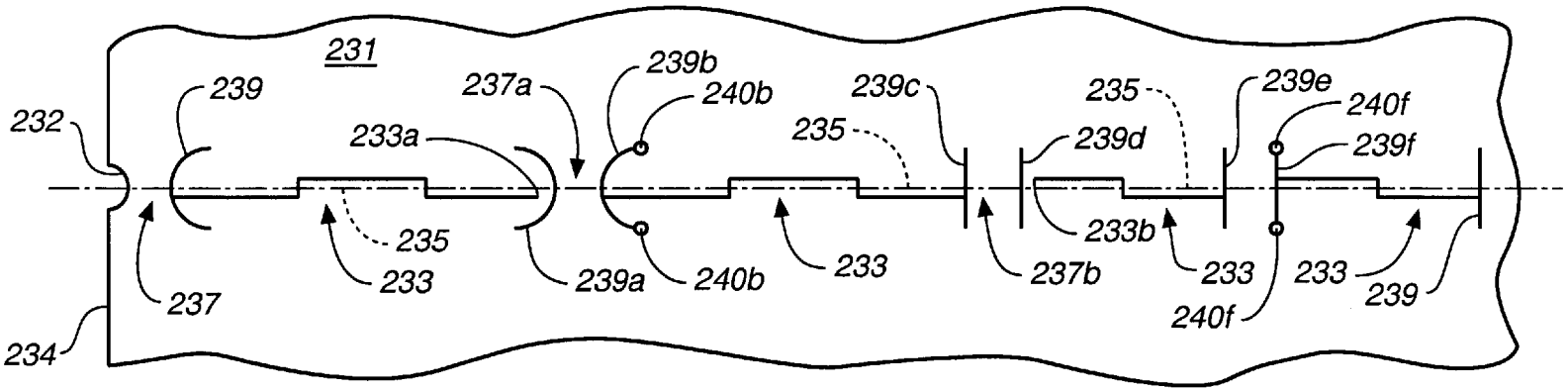
FIG. 3A is a fragmentary, top plan view corresponding to FIG. 1 of a sheet of material which has been slit in accordance with a second embodiment of the first aspect of the present invention and in accordance with a second aspect of the present invention.

A second embodiment of a stress reducing structure is shown in FIG. 3A. A sheet of material 231 is formed with a plurality of aligned longitudinally extending slits 233 extending along a bend line 235. Slits 233 are transversely stepped in a manner which will be described in more detail hereinafter.

Positioned at the adjacent ends of slits 233 are stress reducing structures 239, which in the embodiment of FIG. 3A are provided as transversely extending slits. In the most preferred form of slit-based stress reduction structure 239 the slits are transversely extending arcuate slits, such as shown by slits 239*a* and 239*b*. As will be seen, these arcuate slits curve back along the respective longitudinally extending slits 233 to which they are connected. Thus, the stress reducing arcuate slits are convex in a direction facing intermediate bending webs 237 and 237*a*. Bending webs 237 are defined by an arcuate notch 232 at edge 234 of sheet 231 and the adjacent arcuate stress reducing slit 239, or by pairs of slits 239*a*, 239*b*.

Stress reducing arcuate slits 239, 239*a*, 239*b* also can be seen to preferably be positioned so that the shortest distance between arcuate slits 239*a*, 239*b*, or between a slit 239 and a notch 232, will be located substantially on bend line 235. This provides a stress reducing and bending inducing structure which more precisely produces bending along bend line 235. Considering arcuate stress reducing slits 239*a* and 239*b*, therefore, it will be seen that longitudinally extending slits 233 connect with these arcuate slits at a position below bend line 235 in FIG. 3A, while arcuate slits 239*a*, 239*b* are closest to each other at bend line 235.

For the stepped longitudinally extending slits 233 on the right side of FIG. 3A, linear transversely extending, stress reducing slits 239*c*–239*f* are shown. These linear slits are somewhat less preferred in that they are not as effective in insuring bending on the bend line as are the arcuate stress reducing slits.

It will be understood that stress reducing openings 39, 39*a*, 39*b* and stress relieving slits 239, 239*a*–239*f* could be spaced slightly by a thin web from the ends of the longitudinally extending slits 33 and 233 and still provide protection against the propagation of stress concentration cracks across bending webs 37 and 237. Thus, a small web is shown between the longitudinal slit end 233*a* and the stress reducing slit 239*a* and slit end 233*b* and transverse slit 239*d* in FIG. 3A, which would essentially fail at the start of bending and thereby lengthen the longitudinally extending slit 233 so that it is connected with the stress reducing structure slit 239*a* or 239*d* and prevent further stress induced cracking or crack propagation across webs 237*a* and 237*b*. As used herein, therefore, the expression "connected" shall mean a stress reducing structure which opens to the longitudinally extending slit at the start, or during, bending of the sheet, as well as stress reducing structures which are sufficiently close to the longitudinal slits so as to prevent or block crack propagation across the bending web, even if the thin web between the stress reducing structure and longitudinally extending slit does not, in fact, fail.

A further reduction of stress can be accomplished if opposite ends of the transverse stress reduction slits are provided with enlarged openings, as for example are shown by openings 240*b* and 240*f* on the opposite ends of slit 239*b* and slit 239*f*. Openings 240*b*, 240*f* prevent transverse crack propagation from the ends of the stress reducing slits. While shown only for slit 239*b* and 239*f*, it will be understood that openings 240*b* and 240*f* could be provided at the ends of all of the stress reducing slits.

Figure 3B:
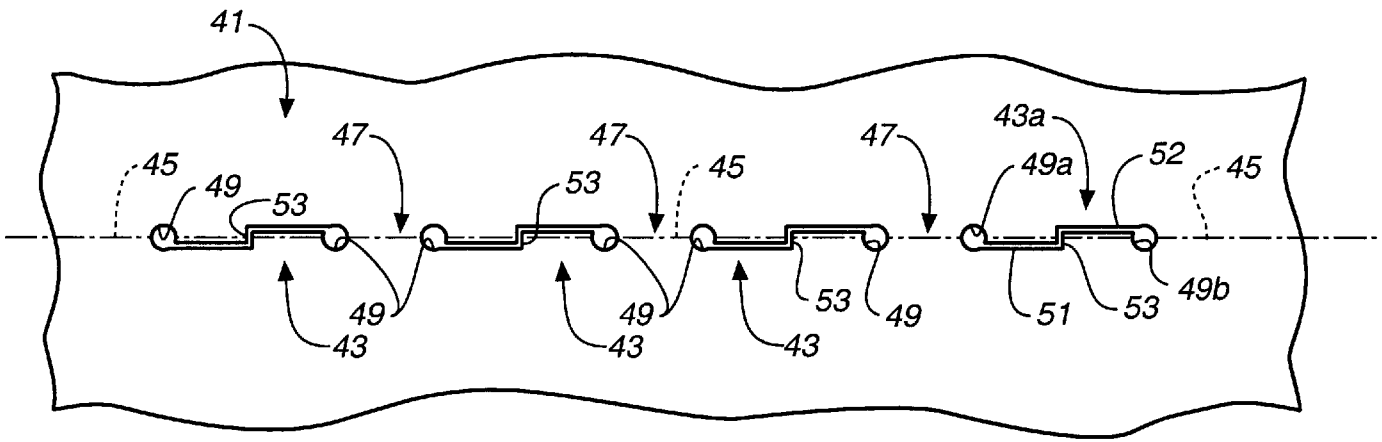
FIG. 3B is a fragmentary, top plan view corresponding to FIG. 1 of a sheet of material which has been slit in accordance with a second aspect of the present invention.

A second aspect of the present precision bending invention is illustrated in FIGS. 3A and 3B. In FIG. 3B a sheet of material 41 is formed with a plurality of slits, generally designated 43, along a bend line 45. Slits 43, therefore, are longitudinally extending and in end-to-end spaced relation so as to define bending webs 47 between pairs of slits 43. Moreover, in FIGS. 3A and 3B, slits 233 and 43 are provided with stress reducing structures at ends thereof, namely slits 239 and openings 49, respectively, so as to effect a reduction in the stress concentration in bending webs 237 and 47. It will be understood from the description below, however, that stress reducing structures such as enlarged openings 49 in FIG. 3B and slits 239 in FIG. 3A, are not required for realization of the benefits of the second aspect of the present invention, as can be seen from the embodiment of FIG. 8.

For slits 233 of FIG. 3A and slits 43 of FIG. 3B, however, each longitudinally extending slit between the slit ends is laterally or transversely stepped relative to bend lines 235 and 45. Thus, a slit, such as slit 43*a*, is formed with a pair of longitudinally extending slit segments 51 and 52 which are positioned proximate to, and preferably on opposite sides of, and substantially parallel to, bend line 45. Longitudinal slit segments 51 and 52 are further connected by a transversely extending slit segment 53 so that slit 43*a* extends from enlarged opening 49*a* to enlarged 49*b* along an interconnected path which opens to both of the enlarged openings and includes both longitudinally extending slit segments 51, 52 and transverse slit segment 53. Similar longitudinal and transverse slit segments are shown in FIG. 3A only the left two slits 233 are composed of three longitudinally extending slit segments and two transversely extending slit segments.

Figure 4A:
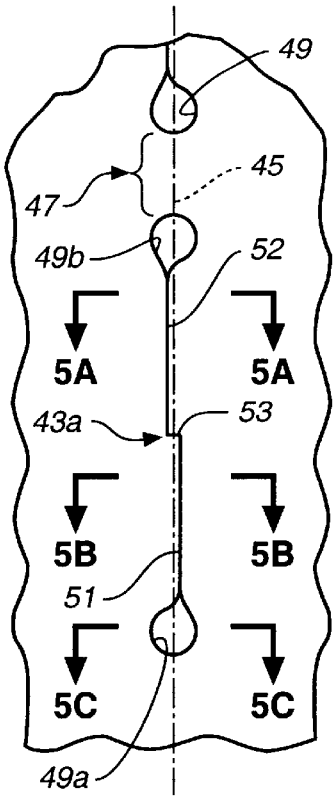
FIGS. 4A–4D are fragmentary, top plan views of a sheet of material which has been slit according to the present invention and is in the process of being bent from a flat plane in FIG. 4A to a 90° bend in FIG. 4D.
Figure 4B:
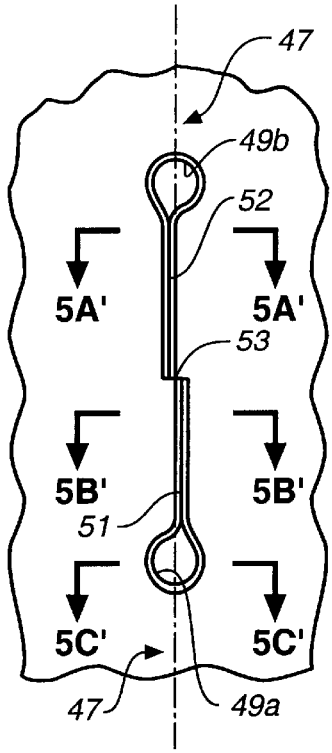
Figure 5A:
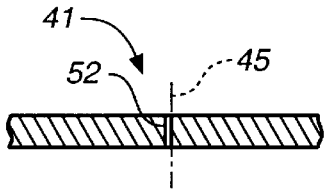
FIGS. 5A–5A''' are fragmentary, cross sectional views, taken substantially along the planes of lines 5A–5A''', in FIGS. 4A–4D during bending of the sheet of material.
Figure 5A:
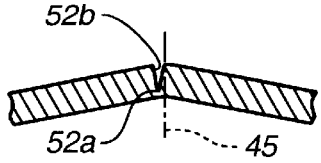
Figure 5B:
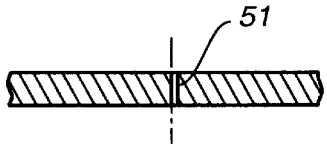
FIGS. 5B–5B''' are fragmentary, cross sectional views taken substantially along the planes of lines 5B–5B''', in FIGS. 4A–4D.
Figure 5B:
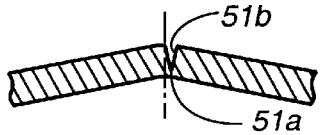
Figure 5C:
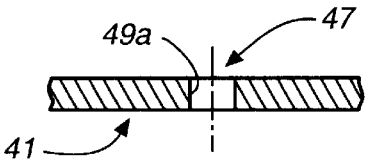
FIGS. 5C–5C''' are fragmentary, cross section views taken substantially along the planes of lines 5C–5C''', in FIGS. 4A–4D.
Figure 5C:
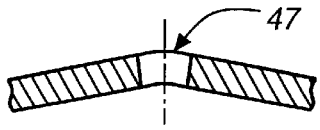

The function and advantages of such stepped slits can best be understood by reference to FIGS. 4A–4D, and the corresponding FIGS. 5A–5C to 5A'"–5C'", wherein the bending of a sheet of material 41, such as shown in FIG. 3B is illustrated at various stages. In FIG. 4A, sheet 41 is essentially slit as shown in FIG. 3B. There is a difference between FIGS. 3B and 4 in that in FIG. 3B a kerf width or section of removed material is shown, while in FIG. 4A the slit is shown without any kerf, as would be produced by a slitting knife. The effect during bending, however, is essentially the same and the same reference numerals will be employed as were employed in FIG. 3B.

Thus, sheet 41 is shown in a flat condition before bending in FIG. 4A. Longitudinally extending slit segments 51 and 52 are shown in FIG. 4A and in the cross sections of FIGS. 5A–5C. The positions of the various cross sections of the sheet are also shown in FIG. 4A.

In FIG. 4B, the sheet has been bent slightly along bend line 45, which can best be seen in FIGS. 5A'–5'C. As can be seen in FIGS. 5A' and 5B', slits 51 and 52 have opened up along their top edges and the portion of the sheet which extends beyond bend line 45 is referred to herein as "tab" 55. The lower or bottom side corners 51*a* and 52*a* of tabs 55 have moved up slightly along a supporting edge 51*b* and 52*b* of the edges of the sheet on the sides of the slit opposite to tabs 55. This displacement of tab corners 51*a* and 52*a* may be better seen in connection with the sheet when it is bent to a greater degree, for example, when bent to the position shown in FIG. 4C.

Figure 4C:
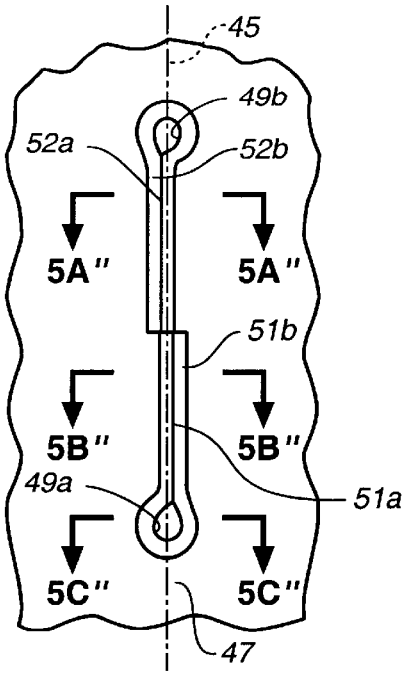

In FIG. 4C it will be seen that tab corners 51*a* and 52*a* have moved upwardly on supporting edges 51*b* and 52*b* of sheet 41 on opposite sides of bend line 45. Thus, there is sliding contact between tabs 51*a* and 52*a* and the opposing supporting edges 51*b* and 52*b* of the slit during bending. This sliding contact will be occurring at locations which are equidistant on opposite sides of central bend line 45 if longitudinal slit segments 51 and 52 are formed in equally spaced positions on opposite sides of bend line 45, as shown in FIG. 4A. The result is that there are two actual bending fulcrums 51*a*, 51*b* and 52*a*, 52*b* spaced at equal distances from, and on opposite sides of, bend line 45. Tab corner 51*a* and supporting edge 51*b* as well as tab corner 52*a* and supporting edge 52*b*, produce bending of bending web 47 about a virtual fulcrum that lies between the actual fulcrums and can be superimposed over bend line 45.

Figure 4D:
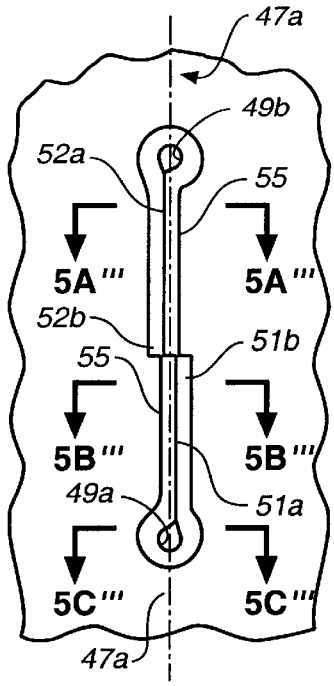
Figure 5A:
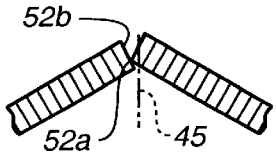
Figure 5A:
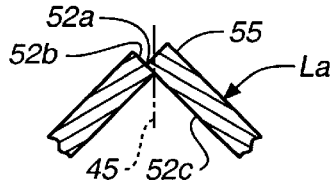
Figure 5B:
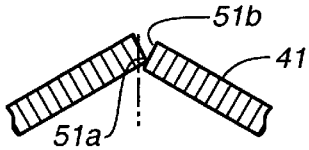
Figure 5B:
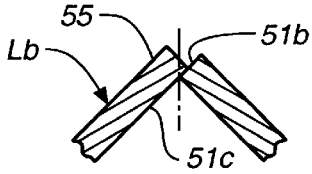
Figure 5C:
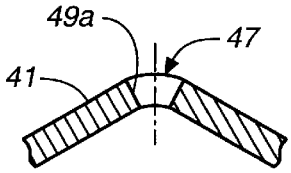
Figure 5C:
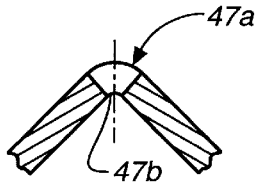

The final result of a 90° bend is shown if FIG. 4D and corresponding cross sections 5'"A–5C'". As will be seen, the sheet bottom side or surface 51*c* now rests on, and is supported in partially overlapped relation to, supporting edge 51*b*. Similarly, bottom surface 52*c* now rests on surface 52*b* in an overlapped condition. Bending web 47 has been plastically deformed by extending along an upper surface of the web 47*a* and plastically compressed along a lower surface 47*b* of web 47, as best illustrated in FIG. 5C'''. In the bent condition of FIG. 4D, the tab portions of the sheet, namely, portions 55, which extend over the center line when the sheet is slit, are now resting on supporting edges 51*b* and 52*b*. This configuration gives the bent piece greater resistance to shear forces at the bend in mutually perpendicular directions. Thus a load $L_a$ (FIG. 5A''') will be supported intermediately bending webs 47 by the overlap of bottom surface 52 on supporting edge 52*b*. Similarly, a load $L_b$ will be supported by overlap of surface 51*c* on supporting edge 51*b* intermediate bending webs 47.

The laterally stepped or staggered slits of the present invention, therefore, result in substantial advantages. First, the lateral position of the longitudinally extending slit segments 51 and 52 can be precisely located on each side of bend line 45, with the result that the bend will occur about a virtual fulcrum as a consequence of two actual fulcrums equidistant from, and on opposite sides of, the bend line. This precision bending reduces or eliminates accumulated tolerance errors since slit positions can be very precisely controlled by a CNC controller. It also should be noted, that press brakes normally bend by indexing off an edge of a sheet. This makes bending at an angle to the sheet edge difficult using a press brake. Bending precisely at angles to the sheet edge, however, can be accomplished readily using the present slitting process. Additionally, the resulting bent sheet has substantially improved strength against shear loading because the overlapped tabs and edges produced by the stepped longitudinally extending slit segments support the sheet against shear loads.

Figure 6:
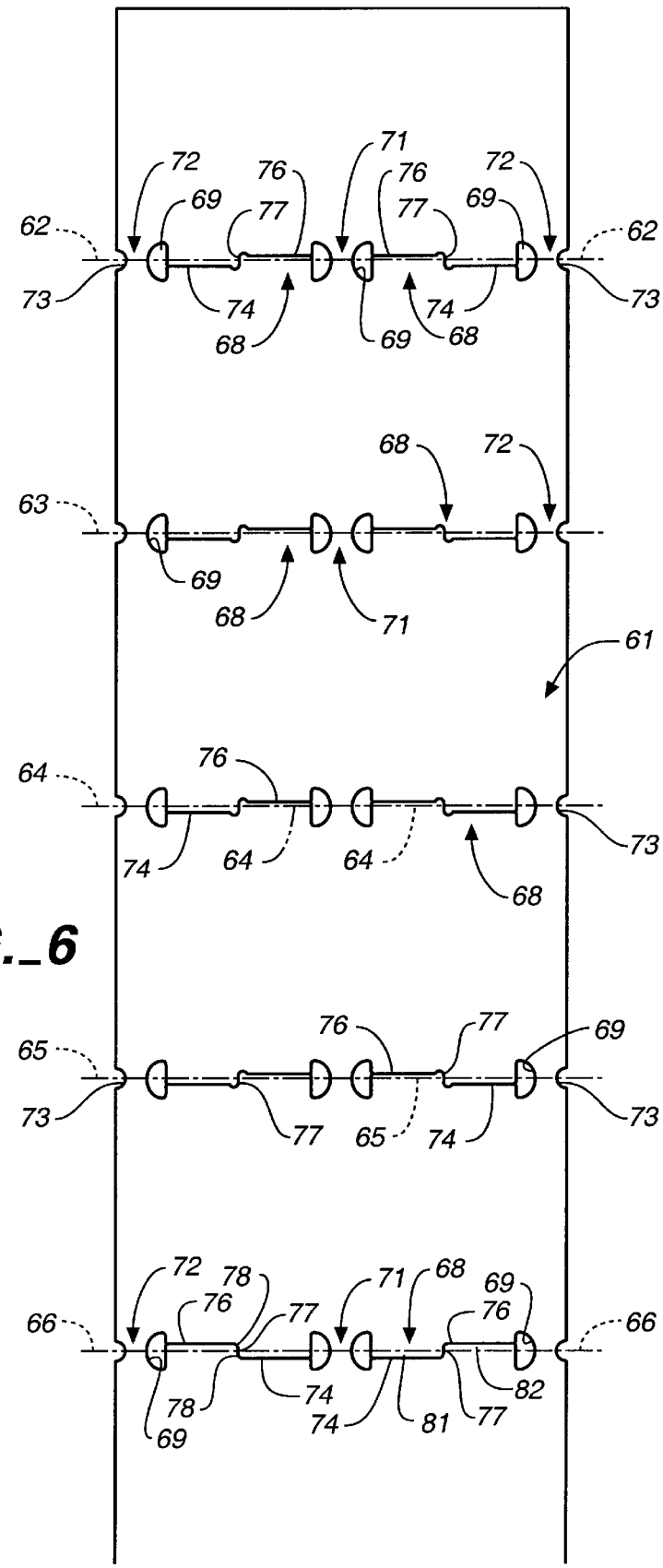
FIG. 6 is a top plan view of a sheet of material which has been slit accordance with an alternative embodiment of the method of the present invention.

Referring now to FIG. 6, an alternative embodiment of a piece of sheet material or stock which has been slit in accordance with the present invention is shown. Sheet 61 is formed with five bend lines 62–66. In each case stepped slits are formed along the bend lines and have pairs of longitudinally extending slit segments positioned proximate to and on opposite sides of bend lines 62–66. The stepped slits, generally designated 68, terminate in D-shaped enlarged openings 69, which in turn, define a central bending web 71 between a pair of slits 68 and side bending webs 72 with notches 73 in opposed edges of sheet 61. The arcuate side of the D-shaped openings 69 reduces stress concentrations in webs 71 and 72, and it can be seen that the outer openings 69 also cooperate with arcuate notches .73 in the sheet edge so that stress concentrations in webs 72 are minimized.

Longitudinally extending slit segments 74 and 76 are connected by S-shaped transversely extending slit segments 77. As was the case for transverse slit segments 53 in FIGS. 3B and 4, transversely extending slit segment 77 include a length which is substantially perpendicular to the bend line over a substantial portion of the transverse dimension of segments 76. The "S" shape is a result of forming slits 68 with a laser or water jet using a numeric controller. Such laser and water jet slit cutting techniques are not well suited to sharp corners, and the "S" shape allows transitioning between the longitudinally extending slit segments 74 and 76 and a transversely extending slit segment 77 without sharp corners.

It is believed that it is highly desirable for the transversely extending slit segment to be substantially perpendicular to the bend line over most of the transverse dimensions so that the tabs formed by the stepped slits are free to engage and pivot off the opposite supporting edge of the sheet of material without interfering engagement of the sheet on opposite sides of the transverse slit segment. Connecting longitudinally extending slit segments 74 and 76 by a transverse slit segment 77 which is at an angle other than 90° to the bend line is illustrated in the far right slit in FIG. 8 and has been employed, but generally, it results in contact along the transverse slit segment which can affect the location of the virtual fulcrum during the bend. Thus, it is preferred to have the transverse slit segment 53 or 77 connect the longitudinal slit segments 51 and 52 or 74 and 76 at a near perpendicular angle to the bend line so that the virtual fulcrum location is determined solely by engagement of the tab corners on opposite sides of the bend line.

In FIG. 6, the difference between the slit configurations along bend line 62, 63, 64 and 65 is the transverse spacing of the longitudinally extending slit segments. Thus the spacing is increased from bend line 62 to the greatest spacing at bend line 65.

At bend line 66, the "S" shape has been replaced by a perpendicular transverse segment 77 which has corners 78 that are rounded to transition to the longitudinally extending slit segments 74 and 76.

Figure 8:
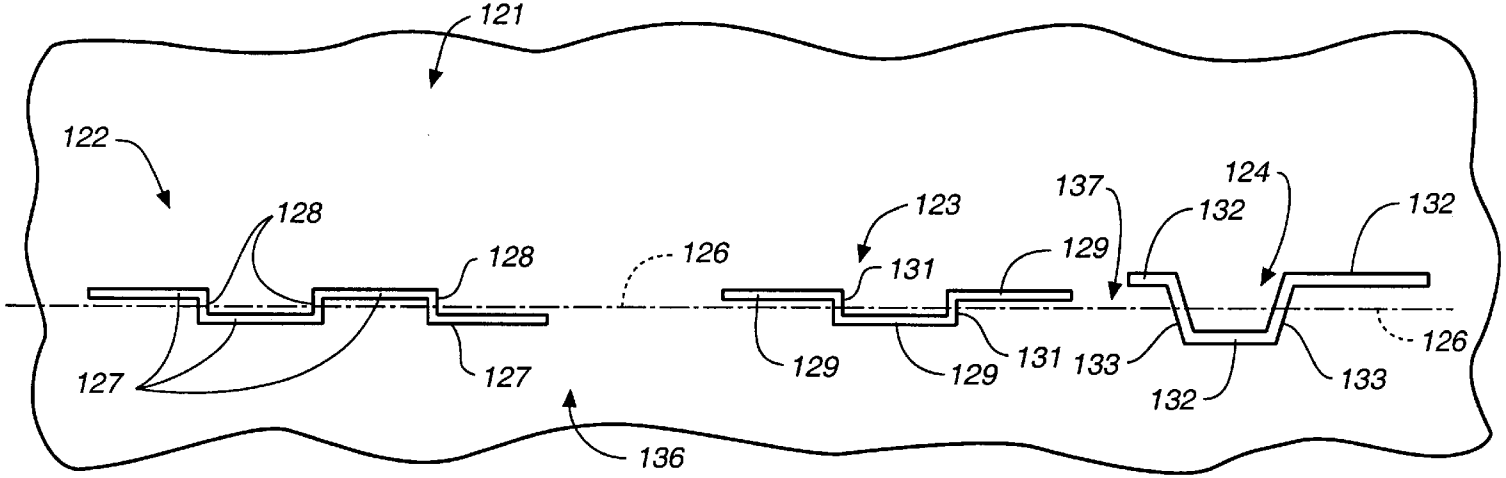
FIG. 8, is a top plan view of a sheet of material which has been slit in accordance with a further alternative embodiment of the present invention.

In each case, it will be seen in FIG. 6 that the transverse slit segment 77 is located at approximately the midpoint of the combined longitudinal length of slit segments 74, 76. This is the preferred form for slitting sheet material of the present invention because is results in the tabs, such as tab 81 and tab 82 shown at bend line 66 having substantially the same length dimension along the bend line. Thus, when the lower corners of tabs 81 and 82 engage the opposite supporting edges of the sheet material on the opposite side of the slit, the length available for pivoting and sliding engagement will be substantially equal on both sides of the bend line. Bending about a virtual fulcrum between the corners of the two tabs will be more reproducible and precise. It will be understood, however, that transverse slit segments 77 could be moved along the length of slit 68 to either side of the center while still retaining many of the advantages of the present invention. In the embodiment of FIG. 8, the far right slit has multiple transverse slit segments which define longitudinal slit segments of differing length. Thus, the transverse slit segments are not evenly distributed along the overall slit length.

The effect of increasing the lateral spacing of longitudinally extending slit segment 74 and 76 relative to the bend line is to tailor the bending as a function of sheet thickness. Generally, as the sheet stock increases in thickness, the kerf of the slit is desirably increased. Moreover, the lateral spacing of the stepped or staggered slit segments also preferably slightly increased. It is desirable to have the longitudinally extending slit segments relatively close to the bend line so that the virtual fulcrum is more accurately positioned.

As the sheet thickens, however, more plastic deformation and bending of webs 71 and 72 is required, and a greater kerf will allow some bending before the lower corners of the tabs begin to engage and slide on the supporting edges of the opposite side of the slit. In this regard, it will be seen from FIGS. 5A''' and 5B''' that tab corners 51*a* and 52*a* slide upwardly along the supporting edges 51*b* and 52*b* to the positions shown in FIGS. 5A''' and 5B'''. Thus, the lower corners of tabs 81 and 82 also are displaced into contact with the supporting edges on the opposite sides of the tabs, and the lower corners slide during the bending process up to an overlapped position in which underneath sides of the tabs are supported on the supporting edges on the opposite side of the longitudinally extending slit segments.

Figure 7:
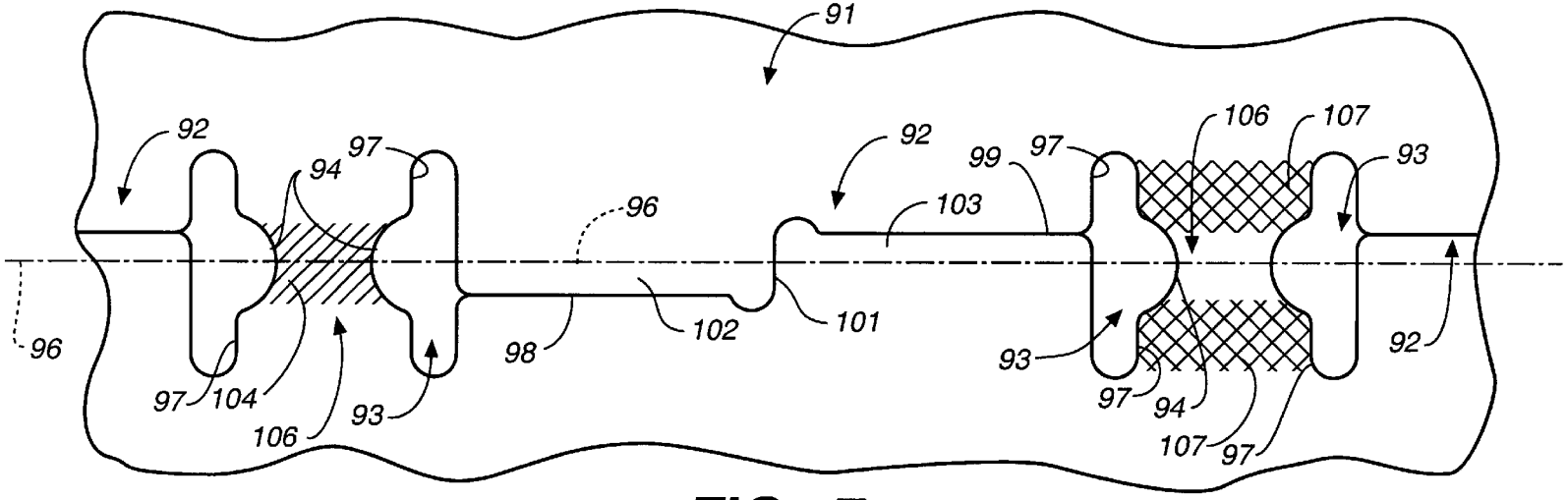
FIG. 7 is an enlarged, fragmentary, top plan view corresponding to FIG. 3 of still a further alternative embodiment of,the slit sheet of a present invention.

In FIG. 7 a further alternative embodiment of a sheet of material which has been slit in accordance with the present invention for precision bending is shown. Sheet stock 91 has been formed with laterally stepped slits, generally designated 92, which terminate in, and open to, hat-shaped stress-relieving enlarged openings 93. The openings 93 can be seen to have a convexly arcuate side 94 which are centered on bend line 96. Extending outwardly from the convex arcuate sides of the openings are lateral extension portions 97 to give the opening its hat-like shape. Each slit 92 is comprised of a pair of longitudinally extending slit segments 98 and 99 connected by a transverse slit segment 101. The longitudinally extending slit segments will be seen to open into openings 93 at one side or the other of bend line 96.

Both the curved enlarged openings 97 and the S-shaped transverse slit segment 101 can be seen to be free of sharp corners so as to permit their formation using laser cutting apparatus or the like.

During bending of sheet 91, the lower corners of tabs 102 and 103 again engage supporting edges on the opposite sides of the slit segments from the tabs. These corners slide along the supporting edges to an upward overlapped position, as above described. During this process an area 104 of bending web 106, which is shown in cross hatching at the left side of FIG. 7, will be plastically deformed. Thus, area 104 between the two convexly arcuate portions 94 of the hat-shaped openings 93 will undergo bending that will not resiliently displace back to its original configuration once the bending force has been removed. The areas 107, shown in cross hatching at the right end of FIG. 7, between the laterally extending portions 97 of openings 93, however, will be elastically deformed. Thus they will experience bending within the elastic limit and will resiliently be displaced in bending as the sheet is bent. Areas 107, however will generally resiliently flatten out once the bending force has been removed. Obviously, webs 106 at each end of FIG. 7 have both a plastic deformation area 104 and elastic deformation areas 107.

It has been found that the use of hat-shaped openings 93 allows the lower tab corners of tabs 102 and 103 to remain in sliding contact with the supporting opposite edges as a result of the resilient elastic deformation of areas 107 of the bending webs 106. In order to control the positioning of the virtual fulcrum, is highly desirable that the lower tab corners which engage the opposing supporting edges do not lift up off the opposed supporting edges during bending. Loss of contact can produce virtual fulcrums which are not precisely aligned with the desired bend line 96.

As shown in FIG. 7, slits 92, and particularly the longitudinal slit segments 98 and 99 and transverse slit segment 101, have zero width dimension, which would be the result of formation with a slitting knife. It will be understood that this is only a schematic representation and that slits 92 can, have a kerf in which material is removed, particularly for thicker sheet stock.

The embodiment of the second aspect of the present invention illustrated in FIG. 8 includes various slit configurations illustrating the range of slitting principle employed. Sheet of material 121 includes three slits, generally designated 122, 123 and 124 which are positioned along a bend line 126. Slit 124 can be seen to be comprised of four longitudinally extending slit segments 127 which are connected by three transversely extending slit segments 128. Each of slit segments 127 are substantially the same length and are spaced from bend line 126 on opposite sides thereof by substantially the same distance.

Slit 123 is similar to slit 124 only there are three longitudinal slit segments 129 connected by two transverse slit segments 131. Finally, slit 124 employs longitudinal slit segments 132 of differing length and multiple transverse slit segments 133 which are not perpendicular to bend line 126. Moreover, longitudinal slit segments 132 of slit 124 are spaced farther from bend line 126 than the longitudinal slit segments in slits 122 and 123. It also will be seen from FIG. 8 that bending web 136 between slits 122 and 123 is longer along bend line 126 than bending web 137 between slits 123 and 124.

It will be understood that still further combinations of longitudinal and transverse slit segments and spacings from bend line 126 can be employed within the scope of the present invention. In order to obtain reproducible bends, however, the longitudinal slit segments preferably are spaced equally on opposite sides of the bend line, transverse slit segments are perpendicular to the bend line, and large transverse steps and small webs between adjacent slit ends, for example as exists at web 137, are not preferred.

From the above description it will be understood that the method for precision bending of a sheet material along a bend line of the present invention is comprised of the steps of forming a plurality of longitudinally extending slits in axially spaced relation in a direction extending along and proximate a bend line to define bending webs between pairs of slits. In one aspect of the present method stress reducing structures, such as openings or arcuate slits, are formed at each of the adjacent ends of the pairs of slits to reduce stress. In another aspect of the method of the present invention, the longitudinally extending slits are each formed by longitudinally extending slit segments that are connected by at least one transversely extending slit segment so as to produce a laterally stepped slit that will bend about a virtual fulcrum. The number and length of the bending webs and slits also can be varied considerably within the scope of both aspects of the present invention. An additional step of the present method is bending the sheet of material substantially along the bend line across the bending web.

The method of the present invention can be applied to various types of sheet stock. It is particularly well suited for use with thin metal sheet stock such as aluminum or steel. Certain type of plastic or polymer sheets and plastically deformable composite sheets, however, also may be suitable for bending using the method of the present invention. The present method and resulting sheets of slit material are particularly well suited for precision bending at locations remote of the slitter. Moreover, the bends may be produced precisely without using a press brake. This allows fabricators and enclosure forming job shops to bend sheets without having to invest in a press brake. Slit sheet stock can also be press brake bent, as well as slit, for later bending by the fabricator. This allows the sheet stock to be shipped in a flat or nested configuration for bending at a remote manufacturing site to complete the enclosure. Press brake bends will be stronger than slit bends so that a combination of the two can be used to enhance the strength of the resulting product, with the press brake bends being positioned, for example, along the sheet edges, or only partially bent to open outwardly slightly so that such sheets can still be nested for shipping.

The bent product which results has overlapping tabs and supporting edges when stepped slits are employed. This enhances the ability of the product to withstand shear forces. If further strength is required, or for cosmetic reasons, the bent sheet material can also be reinforced, for example by welding the bent sheet along the bend line. It should be noted that one of the advantages of forming both the longitudinally extending slits and arcuate slits with essentially zero kerf, as shown in FIG. 3A, is that the bent sheet has fewer openings therethrough along the bend line. Thus, welding or filling, by brazing epoxy or the like, along the bend line for cosmetic reasons is less likely to be required.

A further step in the method of the present invention which produces substantial advantages is to mount, secure or assembly components which are to be contained in the eventual bent sheet, for example, in an enclosure, to the sheet material after it is slit, but before it is bent along the bend lines. Thus, while the sheet is flat and slit for bending, or partially bent and slit for further bending, electronic, mechanical or other components can be secured, mounted or assembled to the sheet and thereafter the sheet can be bent along the bend line resulting from slitting. Bending after the components are positioned as desired in the end product allows the equipment enclosure to be formed around the components, greatly simplifying fabrication of the end product.

Finally, it will be noted that while straight line bends have been illustrated, arcuate bends can also be achieved. Thus, for non-stepped slits, each slit can be arcuate and include a stress reduction structure at the ends. For stepped slits, the longitudinally extending segments can be shortened and curved bends of radii which are not too small can be achieved by laying the stepped short length slits out along the arcuate bend line.

While the present invention has been described in connection with illustrated preferred embodiments, it will be understood that other embodiments are within the scope of the present invention, as defined by the appended claims.

What is claimed is:

1. A method for precision bending of a sheet of material along a bend line comprising the steps of:

selecting a solid sheet of elastically and plastically deformable material;

forming a plurality of longitudinally extending closed-ended slits through said sheet of material in axially spaced relation in a direction extending along and proximate said bend line to define at least one bending web between adjacent ends of at least one pair of said slits;

forming a stress reducing structure at each end of said pair of slits, said structure being formed on said, bend line and connected to said slits;

bending of said sheet of material substantially along said bend line and across said bending web between said openings; and during said bending step, elastically and then plastically deforming said sheet at said web by interengagement of solid edges of said sheet of material on opposite sides of said slits.

2. A method as defined in claim 1 wherein, said forming steps are accomplished by forming said slits with a kerf less than the thickness of said sheet of material, and forming said slits and said stress reducing structure in a sheet of metal.

3. The method as defined in claim 1, and the step of:

prior to said bending step, mounting a component to be contained by said sheet of material after said bending step to said sheet of material.

4. A method of slitting a sheet of material for precision bending along a bend line comprising the steps of:

forming a first elongated slit through said sheet of material to extend in a direction longitudinally along said bend line, said step of forming said first elongated slit being accomplished by forming a pair of proximate, transversely spaced apart, parallel and longitudinally extending first slit segments connected near a common transverse plane by a transversely extending slit segment; and forming a second elongated slit through said sheet of material in substantially longitudinally aligned and longitudinally spaced relation to said first elongated slit to define with said first elongated slit a bending web therebetween, said step of forming said second elongated slit being accomplished by forming a pair of proximate, transversely spaced apart, parallel and longitudinally extending second slit segments connected near a common transverse plane by a transversely extending slit segment.

5. A method as defined in claim 4 wherein, said steps of forming said first slit segments and forming said second slit segments is accomplished by forming said first slit segments and said second slit segments proximate to and on opposite sides of said bend line.

6. A method as defined in claim 5, and the step of:

forming a stress reducing structure in each of the proximate ends of said first elongated slit and said second elongated slit defining said bending web.

7. A method as defined in claim 6 wherein, said step of forming said stress reducing structure is accomplished by forming enlarged openings in said sheet having a width dimension greater than a width dimension of the first elongated slit and the second elongated slit.

8. A method as defined in claim 7 wherein, said step of forming said enlarged openings is accomplished by forming said openings with a shape producing bending along said bend line across said bending web.

9. The method as defined in claim 8 wherein, said step of forming said enlarged openings is accomplished by forming said openings with a substantially circular opening side, with the shortest distance between the circular opening sides of axially adjacent openings falling substantially on said bend line.

10. A method as defined in claim 6 wherein, said step of forming said stress reducing structure is accomplished by forming arcuate slits connected to each of the proximate ends of said fist elongated slit and said second elongated slit, said arcuate slits convexly curving away from said bending web.

11. The method as defined in claim 4 wherein, said forming steps are accomplished by forming said first elongated slit and said second elongated slit in a sheet of metal, and the step of:

after said forming steps, bending said sheet of metal along said bend line.

12. The method as defined in claim 4 wherein, said steps of forming said first elongated slit and said second elongated slit are accomplished by forming said transversely extending slit segments to be substantially perpendicular to said bend line over a substantial portion of the transverse dimension thereof.

13. The method as defined in claim 4 and the additional step of:

forming a plurality of additional elongated slits in end-to-end longitudinal alignment with and in longitudinally spaced relation to, each other and to said first elongated slit and said second elongated slit; and wherein said step of forming said plurality of additional elongated slits is accomplished by forming said addition elongated slits with slit segments as defined for said first elongated slit and said second elongated slit.

14. The method as defined in claim 5 wherein, said step of forming said first slit segments produces a tab on one side of said first slit segments and a mating support edge on an opposite side of said first slit segments; and said step of forming said first slit segments is accomplished by forming said first slit segments to produce sliding engagement of a corner of said tab with said mating support edge during bending of said sheet of material.

15. The method as defined in claim 14 wherein, first elongated slit is formed with one of said pair of elongated slit segments having a tab on one side of said bend line and a supporting edge on an opposite side of said bend line and the other of said pair of elongated slit segments having a tab on said opposite side of said bend line and a supporting edge on said one side of said bend line.

16. The method as defined in claim 15 and the step of:

bending said sheet of material along said first elongated slit segments and said second elongated slit segments to produce sliding engagement of the tabs with the supporting edges on opposite sides of said bend line for bending of said bending web along a virtual fulcrum between the engaged tabs and supporting edges.

17. The method as defined in claim 11, and the step of:

mounting a component to said sheet of material prior to said step of bending said sheet of material along said bend line.

18. The method as defined in claim 4 wherein, said step of forming a pair longitudinally extending first slit segments is accomplished by forming more than two longitudinally extending first slit segments and by connecting longitudinally adjacent pairs of first longitudinally extending slit segments at plurality of common planes by a plurality of transversely extending slit segments.

19. A sheet of material formed for precision bending along a bend line comprising:

a plastically and elastically deformable solid sheet of material having a plurality of elongated closed-ended slits therein spaced apart in end-to-end relation in substantial alignment along said bend line, said slits being formed with a kerf width less than a thickness dimension at said slits of said sheet of material; and stress reducing structures in said sheet of material positioned at ends of, and opening, into said slits.

20. The sheet of material as defined in claim 19 wherein, said stress reducing structures are provided by enlarged openings having transverse width dimensions greater than the transverse width dimensions of said slits and defining a bending web therebetween.

21. The sheet of material as defined in claim 19 wherein, said stress reducing structures are transversely extending slits terminating in enlarged openings at opposite ends.

22. A sheet of material formed for precision bending along a bend line comprising:

a sheet of material having a first elongated slit through said sheet of material extending in a direction longitudinally along said bend line, said first elongated slit being formed by a pair of proximate, transversely spaced apart, parallel and longitudinally extending first slit segments connected near a common transverse plane by a transversely extending slit segment; and said sheet of material having a second elongated slit through said sheet of material in substantially longitudinal alignment with, and in longitudinally spaced relation to, said first elongated slit to define with said first elongated slit a bending web therebetween, said second elongated slit being formed by a pair of proximate, transversely spaced apart, parallel and longitudinally extending second slit segments connected near a common transverse plane by a transversely extending slit segment.

23. The sheet of material as defined in claim 22 wherein, said longitudinally extending first slit segments are positioned on opposite sides of said bend line, and said longitudinally extending second slit segments are positioned on opposite sides of said bend line.

24. The sheet of material as defined in claim 22, and enlarged openings in the proximate ends of said first elongated slit and said second elongated slit defining said bending web, said enlarged openings having a width dimension greater than a width dimension of the first elongated slit and the second elongated slit.

25. The sheet of material as defined in claim 24 wherein, said transversely enlarged openings have a shape producing bending along said bend line across said bending web.

26. The sheet of material as defined in claim 25 wherein, said transversely enlarged openings are formed with a substantially circular opening side, with the shortest distance between the circular opening sides of axially adjacent openings falling substantially on said bend line.

27. The sheet of material as defined in claim 22, and arcuate slits connected to the proximate ends of said first elongated slit and said second elongated slit, arcuate slits curving back along said first elongated slit and said second elongated slit to define a bending web between closest segments of said arcuate slits.

28. The sheet of material as defined in claim 22 wherein, said sheet of material is a sheet of metal, and said sheet of metal being bent substantially along said bend line.

29. The sheet of material as defined in claim 22 wherein, said first elongated slit and said second elongated slit have transversely extending slit segments oriented to be substantially perpendicular to said bend line over substantially the entire transverse dimension thereof.

30. The sheet of material as defined in claim 22 wherein, said first slit segments are tabs positioned on one side of said bend line and mating support edges positioned on an opposite side of said bend line segments.

31. The sheet of material as defined in claim 30 wherein, said sheet of material is bent substantially along said bend line; and said tab on one side of said bend line overlaps and is supported on said supporting edge on an opposite side of said bend line.

32. The sheet of material as defined in claim 22, and a component to be substantially enclosed by said sheet of material upon bending of the same along said bend line, said component being mounted to said sheet of material prior to bending.

33. The sheet of material as defined in claim 22 wherein, said first elongated slit is formed by more than two longitudinally extending first slit segments with each longitudinally adjacent longitudinally extending first slit segment being on opposite sides of said bend line and being connected by a transversely extending slit segment.

34. The sheet of material as defined in claim 33 wherein, said second elongated slit is formed by more than two longitudinally extending second slit segments with each longitudinally adjacent longitudinally extending second slit segments being on opposite sides of said bend line and being connected by a transversely extending slit segment.

35. A method for precision bending of a sheet of material along a bend. line comprising the steps of:

forming a plurality of longitudinal slits extending through said sheet of material in axially spaced relation in a direction extending along and proximate said bend line to define at least one bending web between adjacent ends of at least one pair of said slits;

forming arcuate slits at each of said adjacent ends of said pair of longitudinal slits, said arcuate slits being connected to said longitudinal slits and curving back along each of said slits;

forming enlarged openings at opposite ends of said arcuate slits; and bending of said sheet of material substantially along said bend line and across said bending web between said longitudinal slits.

36. A method for precision bending of a sheet of material along a bend line comprising the steps of:

forming a plurality of longitudinally extending slits through said sheet of material in axially spaced relation in a direction extending along and proximate said bend line to define at least one bending web between adjacent ends of at least one pair of said slits;

forming enlarged D-shaped stress reducing openings at each of said adjacent ends of said pair of slits, said openings having a convex side defining said web and being formed on said bend line and connected to said slits; and bending of said sheet of material substantially along said bend line and across said bending web between said openings.

37. A method for precision bending of a sheet of material along a bend line comprising the steps of:

forming a plurality of longitudinally extending slits through said sheet of material in axially spaced relation in a direction extending along and proximate said bend line to define at least one bending web between adjacent ends of at least one pair of said slits; said step of forming said slits is accomplished by forming at least one slit with a first pair of longitudinally extending slit segments positioned proximate to and on opposite sides of and substantially parallel to said bend line, said longitudinally extending slit segments further having a pair of longitudinally proximate ends connected by a transversely extending slit segment, and one of said longitudinally extending slit segments terminating at an opposite end;

forming an enlarged stress reducing opening at said opposite end of said slit segment, said opening being formed on said bend line and connected to said slit segments; and bending of said sheet of material substantially along said bend line and across said bending web.

38. A method as defined in claim 37 wherein, the step of forming said slits is accomplished by forming an axially adjacent slit along said bend line to said at least one slit, said axially adjacent slit being formed as defined for said at least one slit to have a pair of longitudinally extending slit segments connected by a transversely extending slit segment, and an enlarged opening at an end of said axially adjacent slit proximate and spaced from said opening at said opposite end of said at least one slit to define said web between the openings.

39. A method for precision bending of a sheet of material along a bend line comprising the steps of:

forming a plurality of longitudinal slits having substantially zero kerf and extending through said sheet of material in axially spaced relation in a direction extending along and proximate said bend line to define at least one bending web between adjacent ends of at least one pair of said slits;

forming arcuate stress reducing slit structure at each of said adjacent ends of said pair of longitudinal slits, said arcuate slits being connected to said longitudinal slits and curving away from said bending web and back along said longitudinal slits; and bending of said sheet of material substantially along said bend line and across said bending web between,said openings.

40. A sheet of material formed for precision bending along a bend line comprising:

a sheet of material having a plurality of elongated slits therein spaced apart in end-to-end relation in substantial alignment along said bend line; and stress reducing hat-shaped openings in said sheet of material positioned at ends of, and opening into, said slits, said hat-shaped openings having transverse dimensions greater than the transverse dimensions of said slits and defining a bending web therebetween, said hat-shaped openings have a convexly arcuate shape on a side thereof defining said bending web.

41. A sheet of material formed for precision bending along a bend line comprising:

a sheet of material having a plurality of elongated slits therein spaced apart in end-to-end relation in substantial alignment along said bend line to define a bending web therebetween; and stress reducing transversely extending slits in said sheet of material positioned at ends of, and opening into, said elongated slits, said transversely extending slits terminating in enlarged openings at opposite ends having an opening width greater than the kerb width with said transversely extending skills.

42. A sheet of material formed for precision bending along a bend line comprising:

a sheet of material having a plurality of elongated slits therein spaced apart in end-to-end relation in substantial alignment along said bend line, each of said slits being formed with a plurality of laterally spaced, relative to said bendline longitudinally extending slit segments connected intermediate opposite ends by at least one transversely extending slit segment; and stress reducing openings formed in said sheet of material positioned at opposite ends of said slits and opening into said slit segments.

43. The sheet of material as defined in claim 42 wherein, longitudinally adjacent ones of said longitudinally extending slit segments are parallel to each other on opposite sides of and proximate to said bend line.

44. The sheet of material as defined in claim 43 wherein, said sheet of material is bent substantially along said bend line.

45. The sheet of material as defined in claim 42, and a bend formed in said sheet of material at a position other than said bend line.

46. A method of slitting and bending an elastically and plastically deformable solid sheet of material comprising the steps of:

forming two elongated slits through the sheet of material with each slit being laterally offset on opposite sides of a desired bend line and being longitudinally displaced relative to the other slit along said bend line, said slits having a kerf width dimensioned producing interengagement of solid edges of said sheet of material on opposite sides of said slits during bending; and bending said sheet of material about a virtual fulcrum aligned with said bend line to produce plastic and elastic deformation of said sheet of material along said bend line and interengagement of said solid edges.

47. The method as defined in claim 46 and after said bending step, reinforcing said bends by at least one of welding along, brazing along and filling the bend line with epoxy.

* * * * *

UNITED STATES PATENT AND TRADEMARK OFFICE

CERTIFICATE OF CORRECTION

PATENT NO. : 6,481,259 B1
DATED : November 19, 2002
INVENTOR(S) : Max W. Durney

It is certified that error appears in the above-identified patent and that said Letters Patent is hereby corrected as shown below:

Column 6,
Line 34, delete “5'C” and insert therefor -- 5C' --;
Line 62, delete “5'''A” and insert therefor -- 5A''' --;

Column 16,
Line 54, after “kerb width” delete “with” and insert therefor -- of --; and
Line 62, delete “bendline” and insert therefor -- bend line --.

Signed and Sealed this

Twenty-fourth Day of June, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,481,259 B1
APPLICATION NO. : 09/640267
DATED : November 19, 2002
INVENTOR(S) : Max W. Durney It is certified that error appears in the above-identified patent and that said Letters Patent is hereby corrected as shown below:

In claim 39, column 16, lines 29-30, change “between,said” to --between said--.

Signed and Sealed this

Fourth Day of November, 2008

JON W. DUDAS
*Director of the United States Patent and Trademark Office*

US006481259C1

(12) EX PARTE REEXAMINATION CERTIFICATE (8809th)

United States Patent

Durney

(10) Number: US 6,481,259 C1

(45) Certificate Issued: Jan. 17, 2012

(54) METHOD FOR PRECISION BENDING OF A SHEET OF MATERIAL AND SLIT SHEET THEREFOR

(75) Inventor: Max W. Durney, San Francisco, CA (US)

(73) Assignee: Industrial Origami, Inc., San Francisco, CA (US)

Reexamination Request:
No. 90/009,853, Nov. 17, 2010

Reexamination Certificate for:

| | |
|---|---|
| Patent No.: | **6,481,259** |
| Issued: | **Nov. 19, 2002** |
| Appl. No.: | **09/640,267** |
| Filed: | **Aug. 17, 2000** |

Certificate of Correction issued Jun. 24, 2003.

Certificate of Correction issued Nov. 4, 2008.

(51) Int. Cl.

| | |
|---|---|
| ***B21D 5/00*** | (2006.01) |
| ***B21D 28/00*** | (2006.01) |
| ***E04C 2/08*** | (2006.01) |

(52) U.S. Cl. ..... 72/324; 72/379.2; 428/136; 229/931; 52/658; 493/43

(58) Field of Classification Search ..... None
See application file for complete search history.

(56) References Cited

To view the complete listing of prior art documents cited during the proceeding for Reexamination Control Number 90/009,853, please refer to the USPTO's public Patent Application Information Retrieval (PAIR) system under the Display References tab.

*Primary Examiner*—Patricia Engle

(57) ABSTRACT

A method for precision bending of a sheet of material (31, 41,61,91,231) along a bend line (35,45,62-66,96,235) and the resulting sheet are disclosed. A method includes a step of forming and longitudinally extending slits (33,43, 68,92, 233) through the sheet of material in axially spaced relation to define bending webs (37,47,71,72,106,237), forming stress reducing structures such as enlarged openings (39,49, 69,73) or transversely extending slits (239) at each of adjacent ends of pairs of slits in order to reduce crack propagation across the bending webs. In another aspect, the elongated slits (43,68,92,233) are formed with pairs of longitudinally extending slit segments (51,52;74,76;98, 99;127) proximate to and on opposite sides of and substantially parallel to the desired bend line. Longitudinally extending slit segments further are connected by at least one intermediate transversely extending slit segment (53,77,101, 128). Sheets of slit material suitable for bending also are disclosed.

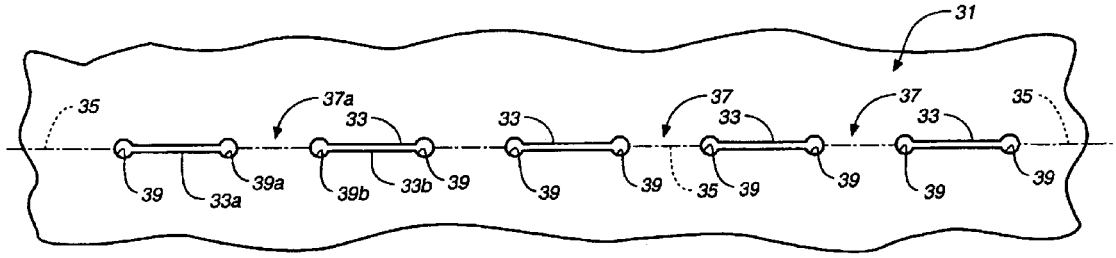

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 19 and 46 are determined to be patentable as amended.

Claims 2, 3, 20, 21 and 47, dependent on an amended claim, are determined to be patentable.

New claims 48 and 49 are added and determined to be patentable.

Claims 4-18 and 22-45 were not reexamined.

1. A method for precision bending of a sheet of material along a bend line comprising the steps of:

selecting a solid sheet of elastically and plastically deformable material;

forming a plurality of longitudinally extending closed-ended slits through said sheet of material in axially spaced relation in a direction extending along and proximate said bend line to define at least one bending web between adjacent ends of at least one pair of said slits;

forming a stress reducing structure at each end of said pair of slits, said structure being formed on said[,] bend line and connected to said slits;

bending of said sheet of material substantially along said bend line and across said bending web between said openings; and during said bending step, elastically and then plastically deforming said sheet at said web by interengagement of solid edges of said sheet of material on opposite sides of said slits[.]*;*

*wherein said stress reducing structures have transverse width dimensions greater than the transverse width dimensions of said slits.*

19. A sheet of material formed for precision bending along a bend line comprising:

a plastically and elastically deformable solid sheet of material having a plurality of elongated closed-ended slits therein spaced apart in end-to-end relation in substantial alignment along said bend line, said slits being formed with a kerf width less than a thickness dimension at said slits of said sheet of material; and stress reducing structures in said sheet of material positioned at ends of, and opening[,] into, slits[,]*;*

*wherein said stress reducing structures have transverse width dimensions greater than the transverse width dimensions of said slits.*

46. A method of slitting and bending an elastically and plastically deformable solid sheet of material comprising the steps of:

forming two elongated slits through the sheet of material with each slit being laterally offset on opposite sides of a desired bend line and being longitudinally displaced relative to the other slit along said bend line, said slits having a kerf width dimension producing interengagement of solid edges of said sheet of material on opposite sides of said slits during bending; and bending said sheet of material about a virtual fulcrum aligned with said bend line to produce plastic and elastic deformation of said sheet of material along said bend line and interengagement of said solid edges[.]*;*

*wherein the virtual fulcrum is provided by two actual fulcrums on opposite sides of the bend line and each actual fulcrum is adjacent to a region of plastic or elastic deformation.*

*48. A method of slitting and bending an elastically and plastically deformable solid sheet of material comprising the steps of:*

*forming two elongated slits through the sheet of material with each slit being laterally offset on opposite sides of a desired bend line and being longitudinally displaced relative to the other slit along said bend line to define at least one bending web portion of said sheet of material between said slits, each of said slits defining a tab portion of said sheet of material extending beyond the bend line, said slits having a kerf width dimension producing interengagement of solid edges of said sheet of material on opposite sides of said slits during bending with, for each slit, a length of a corner of one of said tab portions engaging an opposing edge; and*

*bending said sheet of material about a virtual fulcrum aligned with said bend line to produce plastic and elastic deformation of said web portion of said sheet of material along said bend line and interengagement of said solid edges.*

*49. A method of slitting and bending an elastically and plastically deformable solid sheet of material comprising the steps of:*

*forming two elongated slits through the sheet of material with each slit being laterally offset on opposite sides of a desired bend line and being longitudinally displaced relative to the other slit along said bend line, said slits having a kerf width dimension producing interengagement of solid edges of said sheet of material on opposite sides of said slits during bending with, for each slit, a length of a corner of one of said solid edges supported by, sliding on, and pivoting on the opposing edge; and*

*bending said sheet of material about a virtual fulcrum aligned with said bend line to produce plastic and elastic deformation of said sheet of material along said bend line and interengagement of said solid edges.*

* * * * *